United States Patent [19]

Takechi et al.

[11] 4,011,106

[45] Mar. 8, 1977

[54] HOT-ROLLED STEEL SHEET OF HIGH COLD FORMABILITY AND METHOD OF PRODUCING SUCH STEEL SHEET

[75] Inventors: Hiroshi Takechi, Kisarazu; Hiroaki Masui, Kimitsu; Chikara Fujii; Tsuyoshi Kawano, both of Kisarazu; Kazuo Koyama, Kimitsu, all of Japan

[73] Assignee: Nippon Steel Corporation, Tokyo, Japan

[22] Filed: June 18, 1975

[21] Appl. No.: 588,021

[52] U.S. Cl. ..... 148/2; 148/12 C; 148/36

[51] Int. Cl.[2] ..... C21D 7/13; C21D 9/48

[58] Field of Search ..... 148/2, 12 C, 12 F, 36

[56] References Cited

UNITED STATES PATENTS

| | | | |
|---|---|---|---|
| 3,666,452 | 5/1972 | Korchynsky et al. | 148/12 F |
| 3,666,570 | 5/1972 | Korchynsky et al. | 148/12 F |
| 3,671,336 | 6/1972 | Korchynsky et al. | 148/12 F |
| 3,918,999 | 11/1975 | Sekine et al. | 148/12 F |

*Primary Examiner*—W. Stallard

*Attorney, Agent, or Firm*—Wenderoth, Lind & Ponack

[57] ABSTRACT

A hot-rolled steel sheet of high cold formability characterized in that it contains of 0.03–0.30 % C and 0.15–2.0 % Mn as the main ingredients and also by the average length of sulfide inclusions of stringer form and/or silicate inclusions of like form being less than 100 $\mu$.

4 Claims, 3 Drawing Figures x200 x200

HOT-ROLLED STEEL SHEET OF HIGH COLD FORMABILITY AND METHOD OF PRODUCING SUCH STEEL SHEET

BACKGROUND OF THE INVENTION

The present invention relates to a hot-rolled steel sheet of high cold formability, particularly to a hot-rolled steel sheet of high formability in relation to stretch flanging and bendability, and to a method of producing such steel sheet.

In order to develop a satisfactory steel sheet, particularly a hot-rolled steel sheet, the cold formability, particularly the formability in regard to stretch flanging and bendability, should be improved. Among others, the main factor of lowering such formability in respect to stretch flanging and bendability are stringer inclusions which are sulfide inclusions and silicate inclusions (such inclusions may be hereinafter referred to as A-type inclusions). As for sulfide inclusions, they are represented by MnS in the usual cases; and as for silicate inclusions, they are represented by $MnO.SiO_2$. These two types of inclusions are so highly plastic that they stretch slenderly in the rolling direction during hot-rolling operations, thus resulting in poor cold formability and toughness in the transverse direction of the rolling.

Therefore, the recent study and development efforts for improving cold formability and toughness, are directed to (1) sulfide shape control, which means the conversion of stringer MnS into global sulfide by adding Zr, rare earth metals or the like having strong coherence with S, (2) a special steel making practice to reduce the content of S to less than 0.005 %, thereby reducing the content of MnS, and (3) the decrease of silicate inclusions by the addition of a deoxidizer stronger than Si (such as Al). Each of these means are expensive and undesirable for industrial use.

SUMMARY OF THE INVENTION

The present invention relates to a hot-rolled steel sheet with its cold formability improved without using any special alloy elements or any special steel making practice and a method of producing such steel sheet.

The first object of the present invention is to provide a hot-rolled steel sheet having improved cold formability by dividing long stringer inclusions into small length pieces (less than 100 $\mu$ in average length).

The second object of the present invention is to provide a method of producing hot-rolled steel sheets which by using a final hot-rolling speed of more than or equal to 1100 m/min in finish-rolling of hot strip mill, thereby parting said A-type inclusions into small lengths.

Hereinafter, MnS and silicate inclusions parted into small lengths according to the present invention are also referred to as A-type inclusions.

Other objects of the present invention will be made clear by reference to the detailed explanation given below.

DESCRIPTION OF THE PREFERRED EMBODIMENT

The hot-rolled steel sheet of the present invention is characterized by containing 0.03–0.30 % C and 0.15–2.0 % Mn as the main ingredients, and also by the average length of sulfide inclusions of stringer form and/or silicate inclusions of like form being less than 100 $\mu$.

The method of producing the hot-rolled steel sheet according to the present invention, comprises producing a slab containing 0.03–0.30 % C and 0.15–2.0 % Mn as the main components by the conventional ingot making method or through casting such steel by the continuous casting method, subjecting said slab to hot rolling and finishing rolling the range of 800°–1000° C, and at a finishing rolling speed of more than or equal to 1100 m/min.

In reference to the above, said finishing rolling temperature means the temperature measured on the surface layer of the strip at the outlet of the final finishing rolling stand, whereas said finishing rolling speed means the speed of the rolled strip passing the outlet side of the final finishing rolling stand.

The inventors of the present invention conducted a micro-investigation with a view towards improving the cold formability of the steel in the manner which will be subsequently described.

Even without any change of the total content of MnS and $MnO.SiO_2$, the finishing rolling at a temperature in the range of 800°–1000° C and at a finishing rolling speed of more than or equal to 1100 m/min., can part MnS and $MnO.SiO_2$ contained in the steel into small pieces, resulting in the decrease of the average length of such inclusions to about one third or shorter than the average length of inclusions obtained otherwise. In other words, in the conventional finishing rolling both MnS and $MnO.SiO_2$ have a stringer form, thus heavy stress concentration occurs at their end portions during plastic deformation such as press operation, which may cause cracks in the sheet, resulting in lowered cold formability. But in the rolling at high speed as in the practice of the method of the present invention, MnS and $MnO.SiO_2$ are parted into short lengths, resulting in much smaller stress concentration, than mentioned above, which is considered to improve cold formability, and at the same time, improves impact properties. In the above description, the average length of inclusions means the average length measured of not less than 50 stringer inclusions (including parted MnS and Silicate) measured by the optical microscopic observation of the section in the rolling direction of the steel sheet.

Figure 1:
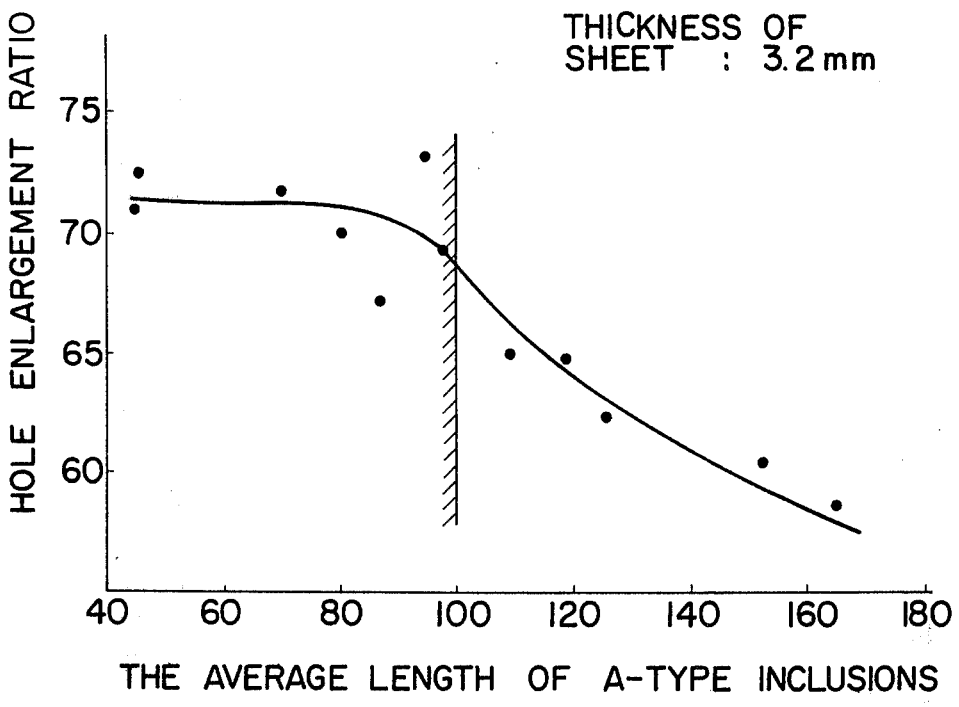
FIG. 1 is a graph showing the correlation between the average length of A-type inclusions and the hole (as sheared) enlargement ratio, where the content of S, the final rolling speed, and the rolling temperature vary, while the other factors remain unchanged, thereby distributing the average length of A-type inclusions between 40 and 160 $\mu$.

In order to secure high cold formability of a steel sheet produced by the high-speed rolling according to the present invention, there must be taken up, as an important factor, the length of sulfide inclusions and silicate inclusions (A-type inclusions). In general, the shorter the length of A-type inclusions, the better; and more particularly, said average length should be less than 100 μ, as shown in FIG. 1. FIG. 1 shows the correlation between the average length of A-type inclusions contained in a hot-rolled steel sheet and the hole (as sheared) enlargement ratio, such average length varying between 40 and 160 μ by changing the content of S in the steel sheet as well as the finishing temperature and finishing rolling speed. As shown in FIG. 1, the influence on the hole enlargement ratio is saturated at about 100 μ of the average length of inclusions.

We imagine the reason thereof is as follows:

When the average length is more than 100 μ, the average length is a important factor and has a great influence on the formability of stretch flanging such as hole enlargement; and in case such length is less than 100 μ, other factors such as structure and grain size, have great influence on the formability of stretch-flanging. More preferably, the average length of A-type inclusions should be less than 80 μ, for stable improvement of the formability of stretch-flanging.

The steel sheet produced by the hot rolling according to the present invention, is used as a structural steel sheet and steel sheet for cold forming, which requires high formability of stretch flanging and bendability or good impact properties. As mentioned above, one object of the present invention is to improve the cold formability of a steel sheet through the decrease of the average length of A-type inclusions under specified hot rolling conditions, without the addition of any special elements nor any special steel making practice. Therefore, the chemical composition of the present inventive steel covers a wide range. Namely the present invention may be applied to all steels which contain A-type inclusions and C-compounds and Mn-compounds as the main components. Besides, there may be additionally contained such elements as Si or Al for improving the strength of the steel or for making killed steel. The addition, as required for further strengthening purposes, of such elements as Nb, V, Mo or Cr for forming carbides and nitrides or of such solid-solution-hardening elements as Ni, or Cu, will not impair the good properties of the present inventive steel sheet having high cold formability, such as stretch-flangeability. A further special characteristic of the present invention lies in the fact that the strength and toughness is improved by utilizing an increased cooling rate which can be naturally accompanied by the high-speed rolling operation.

Therefore, the present invention proves itself more effective when applied to the rolling of steel sheet having a tensile strength of more than 40 kg/mm$^2$ than when applied to the rolling of soft steels which need not possess great strength.

The following is an explanation of the reason for limiting the kinds of chemical composition and production conditions of a steel sheet used in the present invention:

According to the present invention, the content of C is at least 0.03 %. If it should be less than 0.03 %, there will be required a special steel making method, thus pushing up the production cost. As mentioned above, the utilization of the enhanced cooling rate for increasing the strength and the toughness of the product steel is considered as the greatest effect obtainable in the practice of the present invention. In cases where high toughness and strength are required by use of an enhanced cooling rate, the content of C should be preferably more than 0.05 %. More particularly, in pursuit of a structure of fine ferrite and carbide and high toughness as required for structural steel, the content of C may be preferably, more than 0.10 %.

On the other hand, such high-speed rolling, according to the present invention, tends to engender a greater cooling rate after the finishing rolling, therefore, in case the content of C is beyond 0.3 %, the hardenability increases, accordingly lowering cold formability. Therefore, the maximum content of C is set at 0.30 %. Furthermore, from the standpoint of press formability, the smaller the content of pearlite, the better; thus, preferably the content of C may be less than 0.20 %.

Mn should be contained in the steel in amounts of at least 0.15 % for the prevention of red-shortness as well as for deoxidization, and preferably more than or equal to 0.5 % for securing the best effects of high toughness obtainable according to the present invention. More particularly for increasing the strength and also increasing the toughness, the content of Mn may be more than 0.8 %. On the other hand, too much a content of Mn increases hardenability, as well as that of of C and, therefore, the content of Mn should be 2.0 % maximum, while it is preferred to less than 1.7 % for the improvement of weldability.

Other elements of the present invention are as follows. As for S, if less than 0.005 % is present, the average length of A-type inclusions can be reduced to less than 80 μ, even without increasing the rolling speed. Therefore, the when S is present in amounts less than 0.005 % the fundamental advantages of the present invention will not be realized. If the S content is more than 0.025 %, on the contrary, it will become difficult, even if the rolling step of the present invention is employed, to stably hold down the average length of A-type inclusions to less than 100 μ, hence the maximum content of S is preferably 0.025 %. Also because another object of the present invention is to improve the cold formability such as stretch-flanging without using a costly, complicated desulfurization operation nor sulfide shape controls by the addition of special elements, it is preferred to use S in the range of 0.005–0.025 % in the present invention which is the standard level ordinarily employed in steel sheets. However, in order to fully realize the effect of the present invention, the content of S may preferably be between 0.010 and 0.020 %.

In the steel produced without Al deoxidization, such steel containing MnS exhibits low plasticity; thus A-type inclusions are mainly silicate inclusions. The effect of the high-speed rolling according to the present invention is proved conspicuously also in the case of steels containing such silicate inclusions. On the other hand, a steel sheet having good cold formability such as stretch-flanging and bendability, is produced, in most cases, from Al-killed steel and Al-Si killed steel. For Al-killed steel, the content of Al is prescribed to be 0.01–0.10 %. In cases where Al is added in amounts less than 0.01 %, no sufficient deoxidization will take place; and in cases wherein it is added in amounts greater than 0.10 %, the oxide inclusions are increased, accordingly lowering the cold formability of such steel sheet.

If required, the addition of Si is very effective for deoxidization and strength improvement.

One object of the present invention is to part A-type inclusions, during rolling operations, into an average length of less than 100 μ. Therefore, the present invention is applied to steels which contain silicate and is not deoxidized by Al, or to Al-killed steel containing sulfide inclusions, but the present invention has little effects in cases where the steel contains A-type inclusions having an average length of less than 100 $\mu$, even if the rolling conditions according to the present invention are used.

As a result of a great number of experiments conducted by the present inventors, it was found that the present invention is most effective when applied to Si-semikilled steel, Si-killed steel, rimmed or capped steel containing 0.12 % and more C and Al-killed or Al-Si killed steel containing 0.005 % and more S.

The following is an explanation of the reason for limiting the rolling conditions of the steel sheet according to the present invention:

The finishing temperature is the important factor in the practice of the present invention. In the conventional case of ordinary hot-rolling mild steel containing C and Mn as the main ingredients is subjected to rolling at a finishing temperature controlled to less than 850° C for securing the strength of the rolled sheet. On the other hand, in the case of practising the present invention wherein high-speed rolling is employed, the required strength and toughness can be obtained in spite of the high finishing temperature, because the high-speed rolling naturally increases the cooling rate following the finishing rolling, thus the cooling rate passing through $Ar_3$ transformation point, resulting in a fine ferrite and carbide structure. Therefore, it is not necessary to intentionally lower the finishing temperature. On the contrary, in the present invention, the finishing temperature should have a lower limit of 800° C for obtaining high productivity. In the meantime, the application of cooling media, such as water and the like, during the finishing rolling is effective for lowering the finishing temperature. In the practice of the present invention characterized by high-speed rolling as its feature, the productivity is enhanced by increasing the finishing temperature, while the strength and toughness of the rolled product is secured by increasing the cooling rate after rolling.

However, if said finishing temperature goes beyond 1000° C, a great deal of scale accumulates, accordingly lowering the efficiency of the pickling step and increasing the danger of rolled-in scale. Therefore, such high finishing temperature should be avoided. Hereinafter the finishing temperature means the temperature measured on the surface layer of the steel strip at the outlet of the final finishing rolling stand, according to the ordinary nomenclature.

The control of the finishing rolling speed is one of the most important factors of the present invention.

We have examined the relationship between the cold formability and the hot rolling condition. Our examined materials are plain steels containing C and Mn as the main components without any special steel making steps. These steels has been made into slabs by the conventional ingot-making method or by the continuous casting method and then subjected to hot rolling under various conditions. As a result, we found that the higher the finishing rolling speed, the better the cold formability of the rolled steel. The reason for the improvement of the cold formability is that the strain rate of the matrix of such steel is so quickly enhanced by high-speed rolling, that the deformation of MnS and $MnO.SiO_2$ cannot follow said strain rate, resulting in parting the MnS and $MnO.SiO_2$ inclusions, which ordinarily being of stringer form, into small lengths, said phenomena occurring when the final finishing rolling speed is above 1100 m/min. In the rolling of ordinary type, the final finishing rolling speed is about 600 m/min., such speed, however, being enough only for stretching the MnS and MnO into stringer inclusions but not enough for improving the cold formability.

Some kinds of steel contain sulfide inclusions and silicate inclusions which have very high plasticity during hot-rolling. Such inclusions, however, are also parted into small lengths in the case where the rolling speed is more than 1200 m/min.

The present invention does not refer expressly to total reduction at the finishing rolling step, but it is preferable that it be equal to or greater than the level effected for ordinary finishing rolling, that is, more than or equal to 65 %, so as to part the MnS and $MnO.SiO_2$ inclusions into small lengths.

In the practice of the present invention, the coiling temperature tends to get too high in case the cooling water spray at the run-out table is not sufficient or the finishing temperature tends to get too high as a result of high-speed rolling. In this case, the ferrite grain size becomes bigger, resulting in a softer quality of rolled product. However, a sufficient amount of cooling water spray and a significant utilization of the cooling speed increased as a result of the high-speed rolling operation, make it possible to produce a steel of higher toughness and strength than of the steel made by conventional methods.

In the case of producing steel of high toughness and strength, it is preferable that the minimum cooling rate is more than 30° C/sec.. Said cooling rate means the average cooling rate between the finishing temperature and the coiling temperature. More particularly, more than 35° C/sec. is preferred, so as to make a steel sheet having a finer structure and higher strength. On the other hand, a cooling rate which is too high may product a partially hardened structure. Therefore, it is preferable that the maximum cooling rate should be set at 70° C/sec. The application of the cooling media, such as water during the finishing rolling operation, so as to lower the finishing temperature, is effective for the production of steel of high toughness and strength.

Incidentally, the present invention is preferred to producing a steel sheet of less than 8 mm thickness. Because if it is more than 8 mm, high-speed rolling makes it difficult to decrease the rolling temperature and control the finishing temperature within the desired range. The minimum thickness of the steel sheet according to the present invention may go down to about 1.2 mm, which is nearly the lower limit employed in a hot strip mill. The preferable thickness range of the inventive steel sheet is between 1.6 mm and 6.0 mm, taking into consideration the operation efficiency of the hot rolling step.

In the practice of manufacturing a hot-rolled coil, usually, the rolling speed up to the point where the top of the rolled strip is wound at the mandrel (called the threading speed) is comparatively slow. After the top of the strip is wound, the rolling speed is rapidly increased. Therefore, the hot-rolling conditions during said period may possibly be outside the scope of the present invention, as an unavoidable difficulty with the presently available continuous hot-rolling processes. In spite of said difficulty, a hot-rolled sheet produced according to the present invention, obviously preserves the abovementioned advantages.

EXAMPLE

Steel having the chemical composition shown in Table 1 was produced in a converter and made into slab (210 mm thick), which was subjected to soaking at 1250° C and then to roughing rolling. Table 2 shows finishing temperature, the finishing rolling speed, the total reduction of finishing rolling step, the average cooling rate between the finishing temperature and the coiling temperature, the coiling temperature and the thickness of the sheet as the final product. Also, there are shown in Table 2, the average length of A-type inclusions of said sheet, its ferrite grain size (ASTM No.), mechanical properties (By JIS No5 tensile specimen), hole enlargement test results, stretching test results, bending test results and Charpy impact test results (By JIS No4 sub-size).

As for the hole enlargement test, we made a disk of 250 mm in diameter which has a sheared hole of 20 mm in diameter at the center; and a conical punch is inserted into the hole until the crack around the hole is originated. The test result is represented by the hole enlargement ratio, this is $$\frac{D-20}{20} \times 100\ (\%)$$

where: D represents the diameter of the so broken hole.

The higher the ratio the better.

As for the stretching test, we stamped a disk of 250 mm in diameter by a round bottomed punch of 100 mm diameter under a blank holder pressure of 60 tons. And the forming height, when the test piece is broken, is measured as representing the test result.

The higher the forming height, the better.

As for the bending test, a 100 mm wide test piece is bent at ot(bending radius equal zero) in the transverse direction of rolling, and then mark is given according to the below mentioned evaluation standards.

The smaller the mark, the better.

1: No cracks, or only shallow wrinkles.
2: Fine crack production, but crack lengths are not longer than ¼ of the width of the test piece.
3: Small and shallow crack, as long as ¼–½ of the width of the test piece.
4: Deep crack, but crack length no longer than ½ of the width of the test piece.
5: Deep and large crack, as long as more than ½ of the width of the test piece.
6: Broken or nearly broken.

As for impact test, we used a JIS No.4 sub-size specimen and tests at 0° C.

As shown in Table 2, the steel sheets according to the present invention have higher strength, excellent cold formability and toughness.

Figure 2:
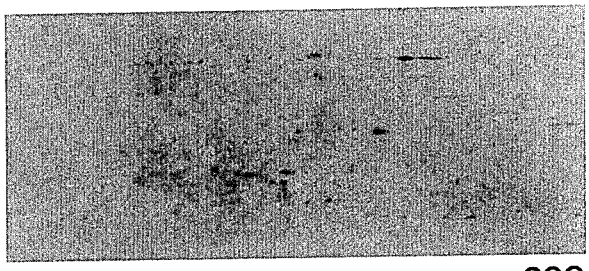
FIG. 2 is a photograph showing the parted A-type inclusions present in the hot-rolled steel sheet (corresponding to Product No. A1shown in Table 2) according to the present invention.
Figure 3:
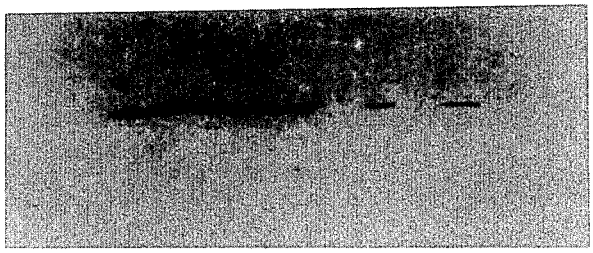
FIG. 3 is a photograph showing the typical A-type inclusions (corresponding to Product No. A5, outside of the present invention) for comparison with the present invention.

FIG. 2 shows parted A-type inclusions contained in the product No. A1 according to the present invention, FIG. 3 shows typical A-type inclusions contained in the product A5, which is outside present invention.

In comparison between A-type inclusions of FIG. 2 and those of FIG. 3, it is observed that the former are parted into shorter lengths than the latter.

The present invention is mainly to be applied to a hot-rolling method and products, but hot-rolled products according to the present invention can be subjected to cold-rolling and annealing. In this case such good effects as high cold formability are preserved.

Table 1

| Product No. | Component (wt%) C | Si | Mn | P | S | Al |
|---|---|---|---|---|---|---|
| A | 0.19 | 0.02 | 0.71 | 0.015 | 0.013 | 0.005 |
| B | 0.15 | 0.49 | 1.52 | 0.014 | 0.015 | 0.032 |
| C | 0.18 | 0.05 | 0.68 | 0.017 | 0.015 | 0.005 |

Table 2

| Kind of Steel | Product No. | Present Invention (o mark) | Finishing Temperature (° C) | Finishing Rolling Speed (m/min) | Total Reduction of Finishing Rolling (%) | *Average Cooling Rate (° C/sec) | Coiling Temperature (° C) | Thickness of Sheet (mm) | Average Length of A-type Inclusions (μ) |
|---|---|---|---|---|---|---|---|---|---|
| A | A 1 | o | 880 | 1250 | 87 | 43 | 550 | 3.2 | 54 |
| | A 2 | o | 845 | 1280 | 87 | 38 | 560 | 3.2 | 61 |
| | A 3 | o | 950 | 1480 | 87 | 56 | 580 | 3.2 | 49 |
| | A 4 | | 890 | 710 | 87 | 22 | 585 | 3.2 | 128 |
| | A 5 | | 835 | 730 | 87 | 21 | 570 | 3.2 | 141 |
| B | B 1 | o | 890 | 1320 | 87 | 38 | 615 | 3.2 | 62 |
| | B 2 | o | 920 | 1560 | 87 | 49 | 620 | 3.2 | 58 |
| | B 3 | o | 860 | 1190 | 87 | 31 | 610 | 3.2 | 88 |
| | B 4 | | 885 | 710 | 87 | 20 | 610 | 3.2 | 142 |
| | B 5 | | 830 | 870 | 87 | 20 | 605 | 3.2 | 146 |
| C | C 1 | o | 850 | 1130 | 77 | 35 | 555 | 6.0 | 64 |
| | C 2 | o | 865 | 1190 | 77 | 37 | 570 | 6.0 | 59 |
| | C 3 | o | 825 | 1150 | 77 | 33 | 550 | 6.0 | 70 |
| | C 4 | | 845 | 680 | 77 | 21 | 550 | 6.0 | 161 |
| | C 5 | | 830 | 705 | 75 | 20 | 560 | 6.0 | 172 |

| Kind of Steel | Ferite Grain Size (ASTM No.) | Mechanical Properties: Yield Point (kg/mm²) | Tensile Strength (kg/mm²) | Elongation (%) | Hole Enlargement Ratio (%) | Forming Height (mm) | Bendability (marks) | Impact Absorbed Energy vEo(kg.m/cm²) |
|---|---|---|---|---|---|---|---|---|
| A | 11.2 | 32.6 | 47.4 | 33.2 | 78 | 57 | 1 | 18.9 |
| | 11.2 | 32.9 | 47.7 | 32.9 | 76 | 59 | 1 | 18.4 |
| | 11.4 | 33.4 | 48.4 | 32.4 | 82 | 60 | 1 | 18.6 |
| | 10.1 | 27.4 | 45.2 | 34.2 | 56 | 49 | 2 | 14.7 |
| | 10.8 | 31.6 | 46.9 | 33.4 | 53 | 47 | 2 | 14.1 |
| | 11.3 | 42.4 | 58.4 | 27.6 | 63 | 52 | 2 | 16.4 |

Table 2-continued

| | | | | | | | | |
|---|---|---|---|---|---|---|---|---|
| | 11.5 | 42.9 | 58.6 | 26.8 | 61 | 51 | 2 | 15.8 |
| B | 11.2 | 42.1 | 58.2 | 26.9 | 57 | 53 | 2 | 16.5 |
| | 10.2 | 37.6 | 53.1 | 28.6 | 47 | 42 | 4 | 11.5 |
| | 10.7 | 40.4 | 57.2 | 27.9 | 44 | 40 | 4 | 10.2 |
| | 10.5 | 31.2 | 45.8 | 41.5 | 60 | 65 | 2 | 16.4 |
| | 10.4 | 30.4 | 45.1 | 41.2 | 62 | 67 | 2 | 16.7 |
| C | 10.7 | 31.7 | 46.3 | 40.6 | 62 | 65 | 2 | 15.8 |
| | 9.8 | 28.2 | 43.4 | 41.3 | 49 | 58 | 5 | 13.2 |
| | 10.0 | 29.1 | 44.8 | 40.7 | 48 | 56 | 5 | 13.7 |

*The average cooling rate between finishing temperature and coiling temperature

What is claimed is:

1. A method of producing a hot-rolled steel sheet having high cold formability which comprises producing a steel slab from sheet consisting essentially of 0.03–0.30%C and 0.15–2.0%Mn as the main additive ingredients by an ingot making or continuous casting method, said steel being free from sulifde shape-controlling agents, followed by hot-rolling said slab at a finishing temperature in the range of 800°–1000° C and at a finishing rolling speed of more than or equal to 1100 m/min. so as to make the average length of the sulfide and/or silicate inclusions of stringer form in the steel less than 100 $\mu$.

2. A method according to claim 1 characterized in that the average cooling rate between the finishing temperature and coiling temperature is more than 30° C/second.

3. A method according to claim 1 wherein the C content is 0.05–0.30% whereas the Mn content is 0.5–2.0%.

4. A hot-rolled steel sheet produced by the process according to claim 1 characterized in that the steel contains 0.03–0.30%C and 0.15–2.0% Mn as the main components and sulfide inclusions of stringer form and/or silicate inclusions of stringer form of which the average length is less than 100 $\mu$.

* * * * *